US007251856B2

(12) United States Patent
Kaffenberger et al.

(10) Patent No.: US 7,251,856 B2
(45) **Date of Patent: *Aug. 7, 2007**

(54) VACUUM CLEANER NOZZLE FOR FLOORS AND CARPETS

(75) Inventors: Dieter Kaffenberger, Wiehl (DE); Thomas Lind, Freudenberg (DE)

(73) Assignee: Wessel-Werk GmbH & Co. KG, Reichshof-Wildergerhütte (DE)

( * ) Notice: Subject to any disclaimer, the term of this patent is extended or adjusted under 35 U.S.C. 154(b) by 658 days.

This patent is subject to a terminal disclaimer.

(21) Appl. No.: 10/778,976

(22) Filed: Feb. 13, 2004

(65) Prior Publication Data

US 2004/0216267 A1 Nov. 4, 2004

(30) Foreign Application Priority Data

Feb. 20, 2003 (DE) ..... 103 07 176

(51) Int. Cl.
*A47L 9/06* (2006.01)

(52) U.S. Cl. ..... 15/373; 15/368

(58) Field of Classification Search ..... 15/367, 15/368, 369, 373, 393, 401, 402
See application file for complete search history.

(56) References Cited

U.S. PATENT DOCUMENTS

| | | | | |
|---|---|---|---|---|
| 5,539,953 | A * | 7/1996 | Kurz | 15/367 |
| 2002/0083552 | A1* | 7/2002 | Dilger et al. | 15/373 |
| 2005/0262659 | A1* | 12/2005 | Roschi et al. | 15/368 |

FOREIGN PATENT DOCUMENTS

| | | |
|---|---|---|
| DE | 40 16 464 | * 11/1990 |
| DE | 196 28 070 | 1/1998 |
| DE | 197 38 046 | 3/1999 |

* cited by examiner

*Primary Examiner*—Terrence R. Till
(74) *Attorney, Agent, or Firm*—Collard & Roe, P.C.

(57) ABSTRACT

A vacuum cleaner nozzle for floors and carpets having a housing comprised of an upper part and a slide sole, a pivotable rocker located in the housing on a rear segment in working direction and an actuating lever to operate the rocker. Strip-shaped gasket elements are attached to the rocker, which are arranged in working direction in front of and behind a suction port formed into the slide sole and can be retracted and moved out of openings on the lower side of the housing with a pivoting movement of the rocker.

5 Claims, 7 Drawing Sheets

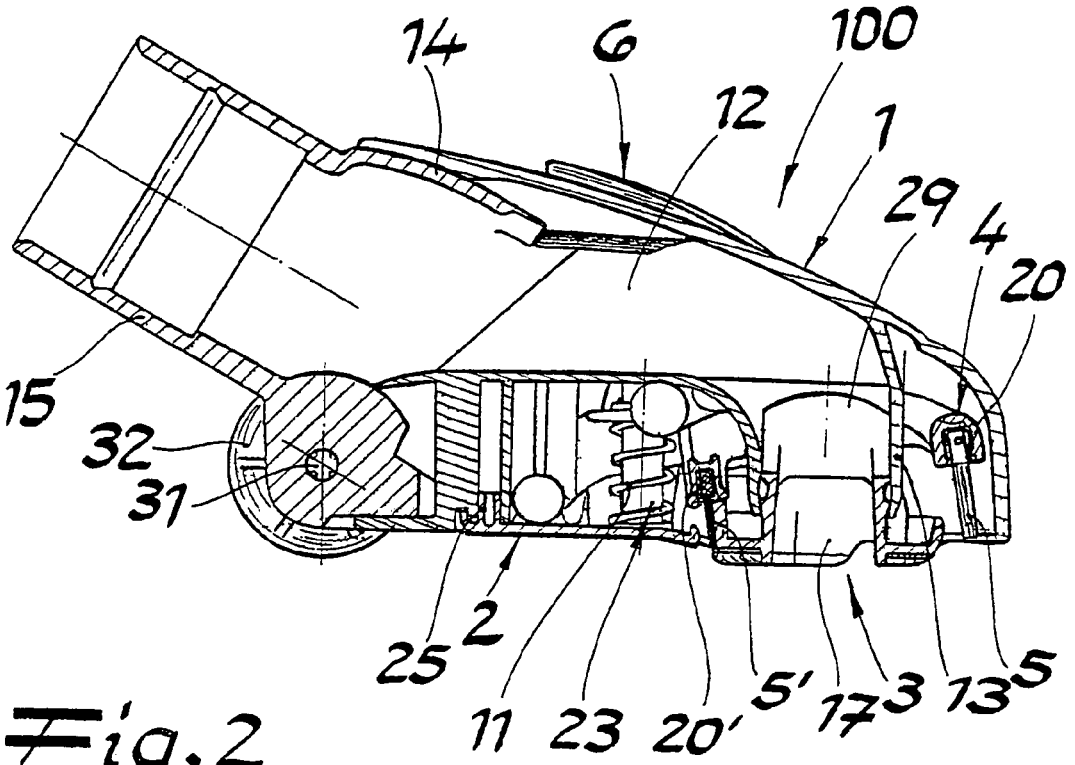
Fig.2
Fig.3
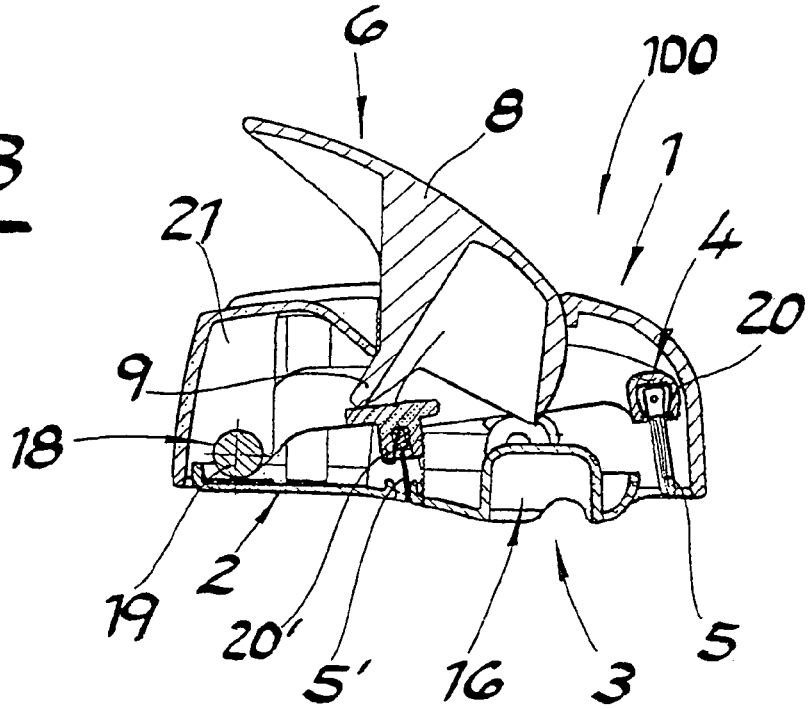

15
31
32
1
7
6
8
19
26
4
20'
22
20
11
5'
5
100
25
28'
28
29
17
2
3
30

VACUUM CLEANER NOZZLE FOR FLOORS AND CARPETS

BACKGROUND OF THE INVENTION

1. Field of the Invention

The invention relates to a vacuum cleaner nozzle for floors and carpets.

2. The Prior Art

Vacuum cleaner nozzles with gasket elements that can be developed as bristle strips or elastomer strips are known. When vacuuming carpets, the gasket elements are retracted in the interior of the housing and the slide sole rests on the floor covering. To vacuum smooth floors, the gasket elements are moved out with an adjustment movement of the gasket base at the lower side of the nozzle, and support the upper part of the housing on the floor. The gasket base is often developed as a metal plate that is arranged to be vertically adjustable in the upper part of the housing and can be lowered against the action of return springs by means of a tilting lever that acts on the base plate, such as shown in German Patent No. DE 196 28 070 A1. The production of such vacuum cleaner nozzles requires a comparatively high effort.

German Patent Application No. DE 197 38 046 A1 discloses a swivel-motion support of the base around a stationary housing swivel axis, which is arranged in the a rear segment of the upper part of the housing. A bristle strip that reaches through a gap between-the slide sole and the upper part of the housing during a swivel movement of the base is attached to the gasket base, which is developed as a rocker. However, the sealing function of the individual bristle strip and thus the cleaning effect when vacuuming of the floor, is limited.

SUMMARY OF THE INVENTION

It is therefore an object of the invention to provide a simple and cost-efficient vacuum cleaner nozzle for floors and carpets that cleans floors as efficiently as it does carpets.

This object is achieved according to the invention by a vacuum cleaner nozzle for floors and carpets having:

a housing comprised of an upper part and a slide sole, a pivotably supported rocker located inside the housing at a rear segment in working direction, and an actuating lever to operate the rocker, with strip-shaped gasket elements attached at the rocker, which are arranged in the working direction in front of and behind a suction port in the slide sole and can be retracted and moved out of openings at the lower side of the housing with a swivel motion.

The rocker allows a simple and therefore cost-efficient construction of the nozzle. The gasket elements arranged in front of and behind the suction port in the working direction achieve a very good sealing effect during the vacuuming of floors, thus ensuring a good cleaning effect of the vacuum cleaner nozzle on smooth floors as well.

In a preferred embodiment of the invention, the rocker is comprised of a pin-jointed frame plastic molding having a rod with cylindrical bearing surfaces and parallel profile strips to fasten the gasket elements, as well as cross-members that connect the rod and the profile strips. The cross-members are arranged on both sides of a suction channel that runs in the inside of the housing to an opening in the suction port. This allows a simple and cost-efficient production of the rocker, for example as a one-piece injection-molded part. Preferably, the rocker is guided on pivots that extend from the slide sole to the upper part of the housing and brace the housing. The rocker is loaded by at least one return spring, which can be developed as a torsion spring or a coil spring. Preferably, it is supported on coil springs that-are arranged on the pivots. This further simplifies the construction of the vacuum cleaner nozzle and provides the rocker with a very high functionality, in particular when moving out and retracting the gasket elements.

The rocker may have two respective cross-members on each side of the suction channel, with the actuating lever dipping into the free space between adjacent cross-members and with contact surfaces that also cooperate with the actuating lever being arranged between the cross-members. Despite the simple construction of the rocker, this lends the rocker a high stability and thus load capacity, and it furthermore enables a compact structure of the nozzle. The actuating lever is preferably comprised of a pivoted shaft, at least one actuating surface developed as an impact switch, and formed cam lobes, with the cam lobes acting on an assigned contact surface of the rocker. Then the actuating lever can be produced in a simple and cost-efficient manner, for example also as a one-piece injection-molded part. The construction described above guarantees a simple and therefore safe cooperation of actuating lever and rocker.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views:

FIG. 2 shows a longitudinal section along lines II-II of FIG. 1;

FIG. 3 shows a section along lines III-III of FIG. 1;

DETAILED DESCRIPTION OF THE PREFERRED EMBODIMENT

Figure 1:
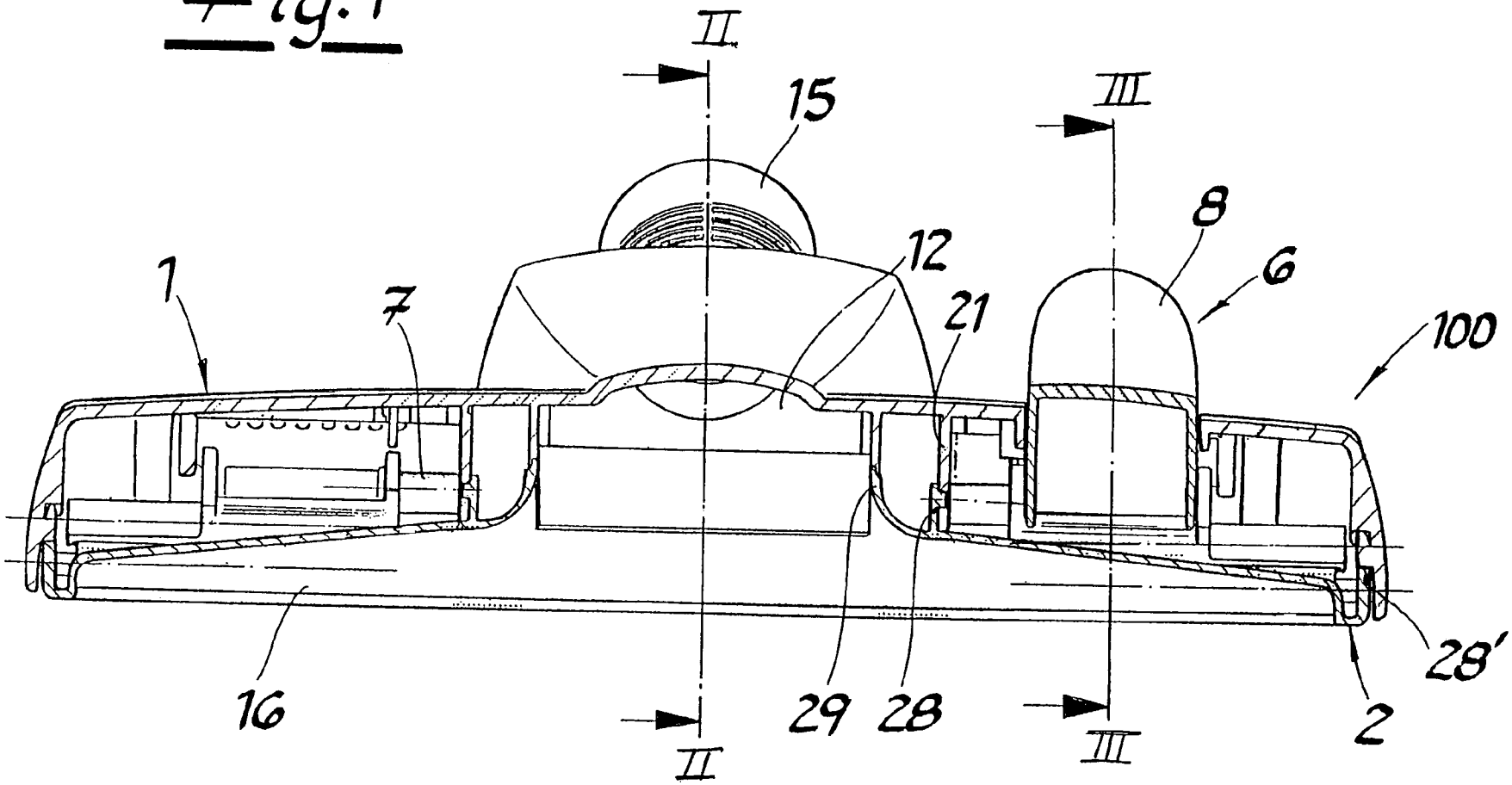
FIG. 1 shows a frontal sectional view of the vacuum cleaner nozzle in accordance with the invention.

The vacuum cleaner nozzle shown in the figures can be used for floors and carpets either directly or with the interconnection of a flexible line on the suction side of a vacuum cleaner device. The principal structure of the vacuum cleaner nozzle includes a housing 100 with an upper housing part 1 made of plastic and a plastic slide sole 2 having a suction port 3 as well as a rocker 4 adjustably arranged inside upper housing part 1 with strip-shaped gasket elements 5, 5' arranged in working direction in front of and behind suction port 3. Gasket elements 5, 5' can be moved in and out of the openings at the lower side of housing 100 with a swing movement of rocker 4. The nozzle includes an actuating lever 6 comprised of a pivotable shaft 7, at least one actuating surface developed as an impact switch 8 as well as formed cam lobes 9 that act on a respective contact surface 10 of rocker 4. There are return springs 11 acting on rocker 4. A suction channel 12 is formed on upper part 1 of the housing, which has on its one end a connecting piece 13 connected to slide sole 2 and is developed at the other end as a joint cup 14 of a hinge joint 15. Suction channel 12 forms a projection in the inside of the housing, which is comprised of upper part 1 of the housing and slide sole 2. Suction port 3 is comprised of a flow channel 16 formed into slide sole 2, which extends from a central opening 17 that runs into suction channel 12 transversely to suction channel 12. Rocker 4 is also arranged in upper part 1 of the housing to pivot around an axis 18 and is comprised of a pin-jointed frame plastic molding having as a first longitudinal member a rod 19 with cylindrical bearing surfaces, for example in form of an integral shaft. Parallel to the rod are two profile strips 20, 20' that brace the pin-jointed frame as additional longitudinal members to connect the gasket elements 5, 5'. Profile strips 20, 20' are arranged in front of and behind suction port 3 in working direction, with a bristle strip 5 being connected to front profile strip 20 and a rubber gasket lip 5' being connected to rear profile strip 20'. During a pivot movement of rocker 4, bristle strip 5 reaches through a gap between the slide sole 2 and the upper part 1 of the housing. Gasket lip 5' can be retracted and moved out through a slit in the integrally developed slide sole 2.

Figure 6:
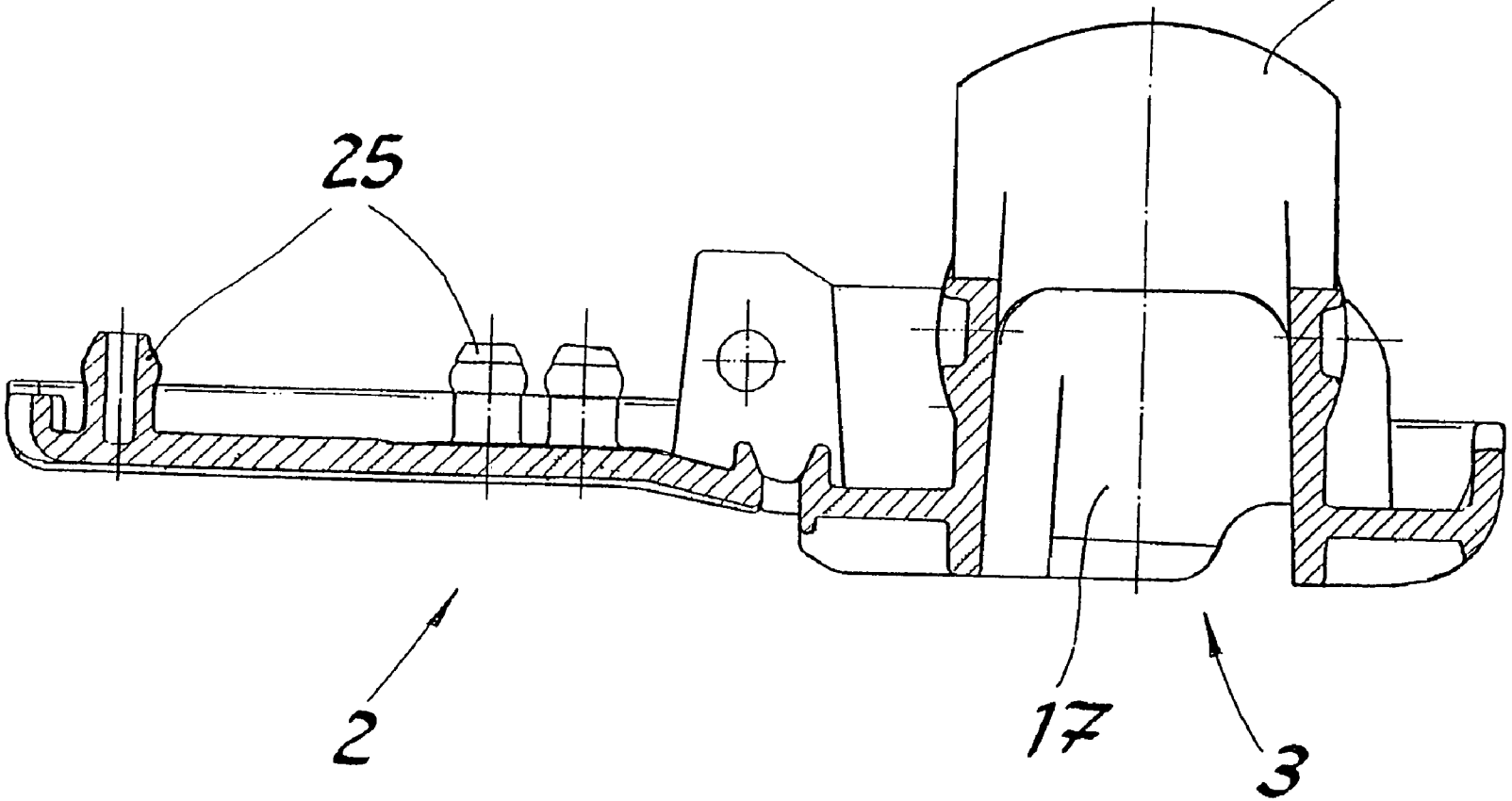
FIG. 6 shows a section along lines VI-VI of FIG. 5.
Figure 7:
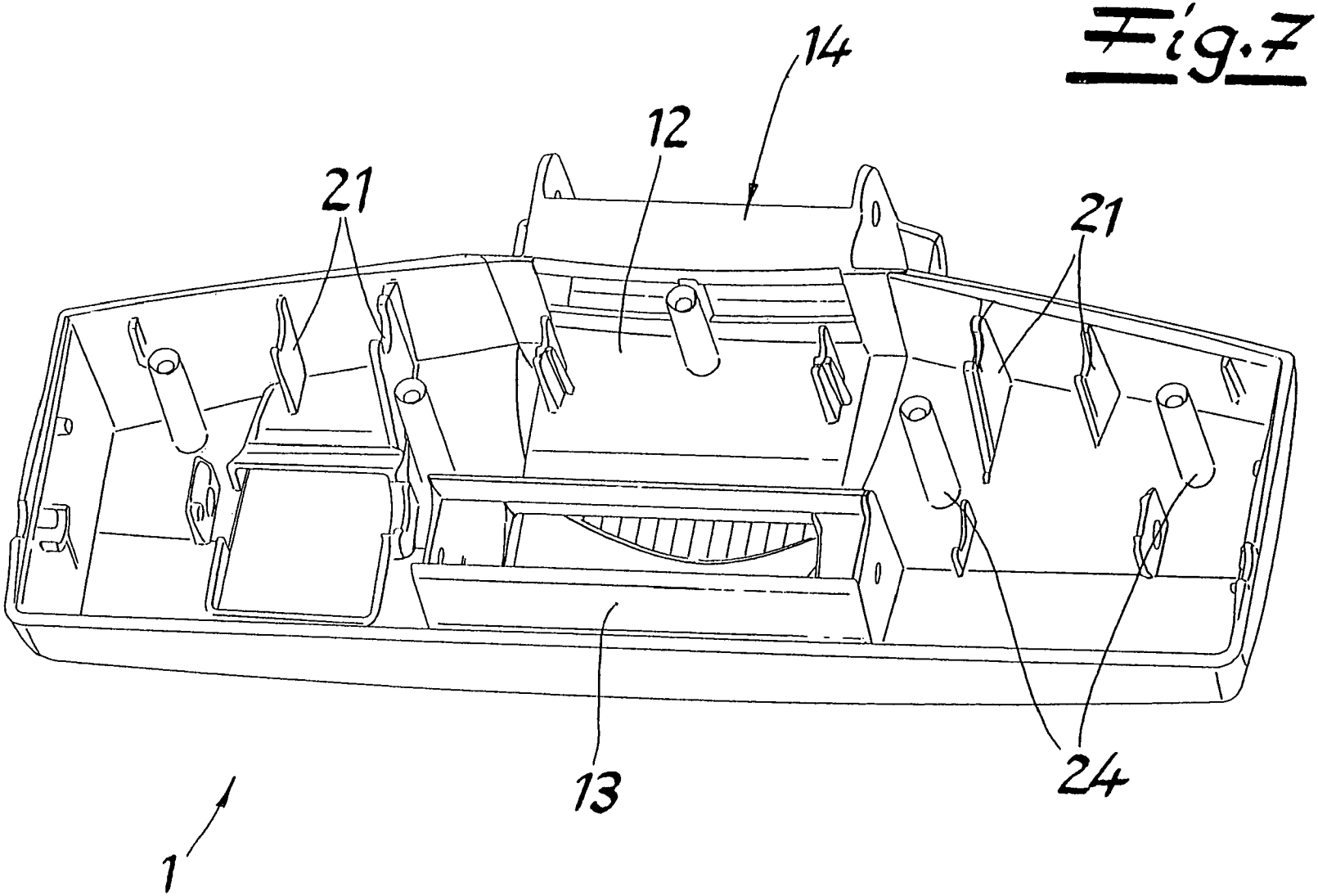
FIG. 7 shows an interior view of the upper part of the vacuum nozzle housing.
Figure 8:
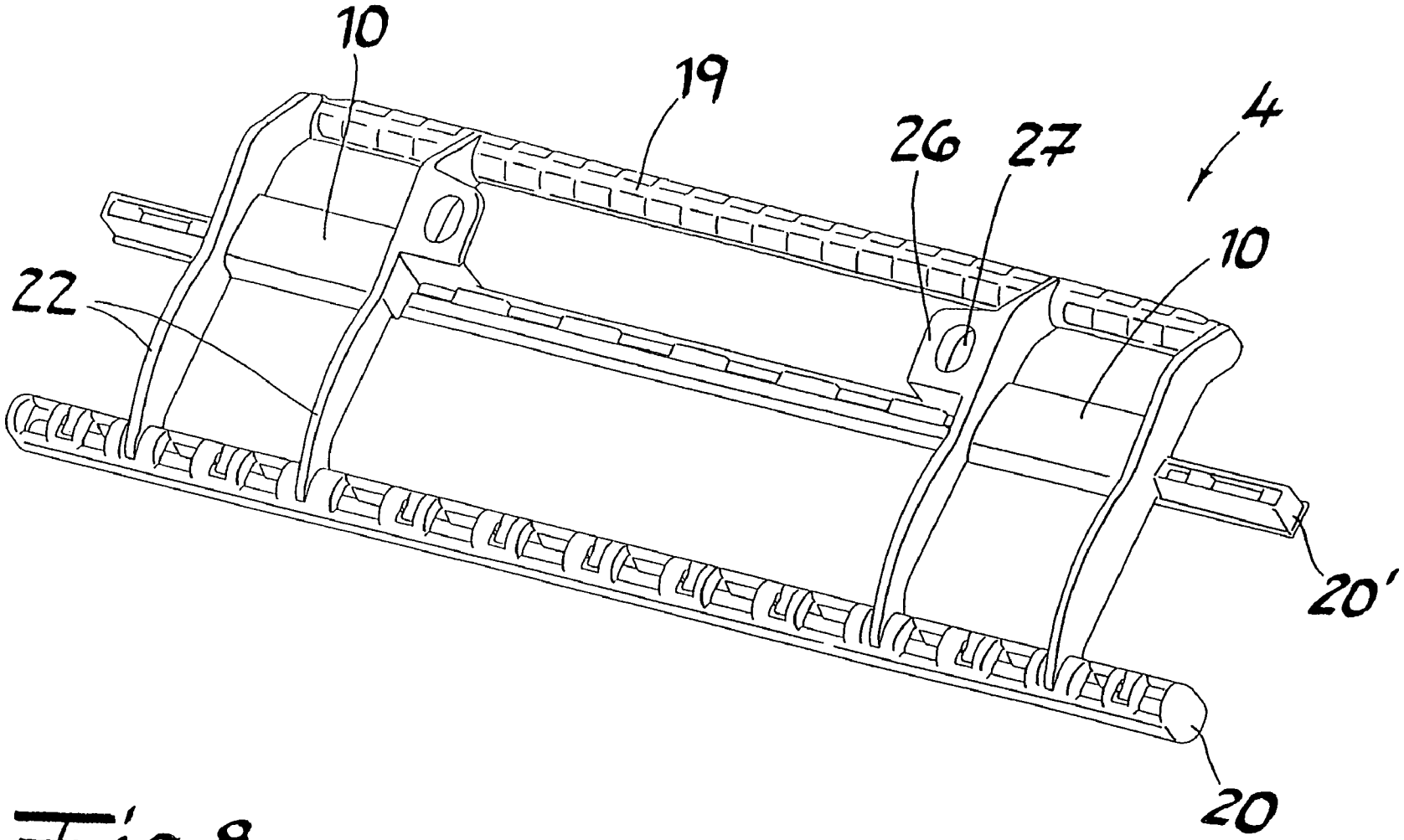
FIG. 8 shows a single component drawing of the gasket base in a representation that is enlarged relative to FIG. 4.

Rod 19, which is developed with cylindrical support surfaces, for example as a shaft, is rotationally held in a rear segment of upper part 1 of the housing in working direction, between slide sole 2 and formed bearing webs 21 of upper part 1 of the housing. The longitudinal members 19, 20, 20' are connected by one-piece formed cross-members 22 arranged at both sides of suction channel 12. Slide sole 2 is fastened at upper part 1 of the housing with permanent joint slip joints 23 between pivot-shaped projections 24 of the upper part of the housing and counter elements 25 formed onto the slide sole. Counter-elements 25 are developed as stump-shaped cylindrical elements with a mushroom head, as shown in FIG. 6.

Figure 5:
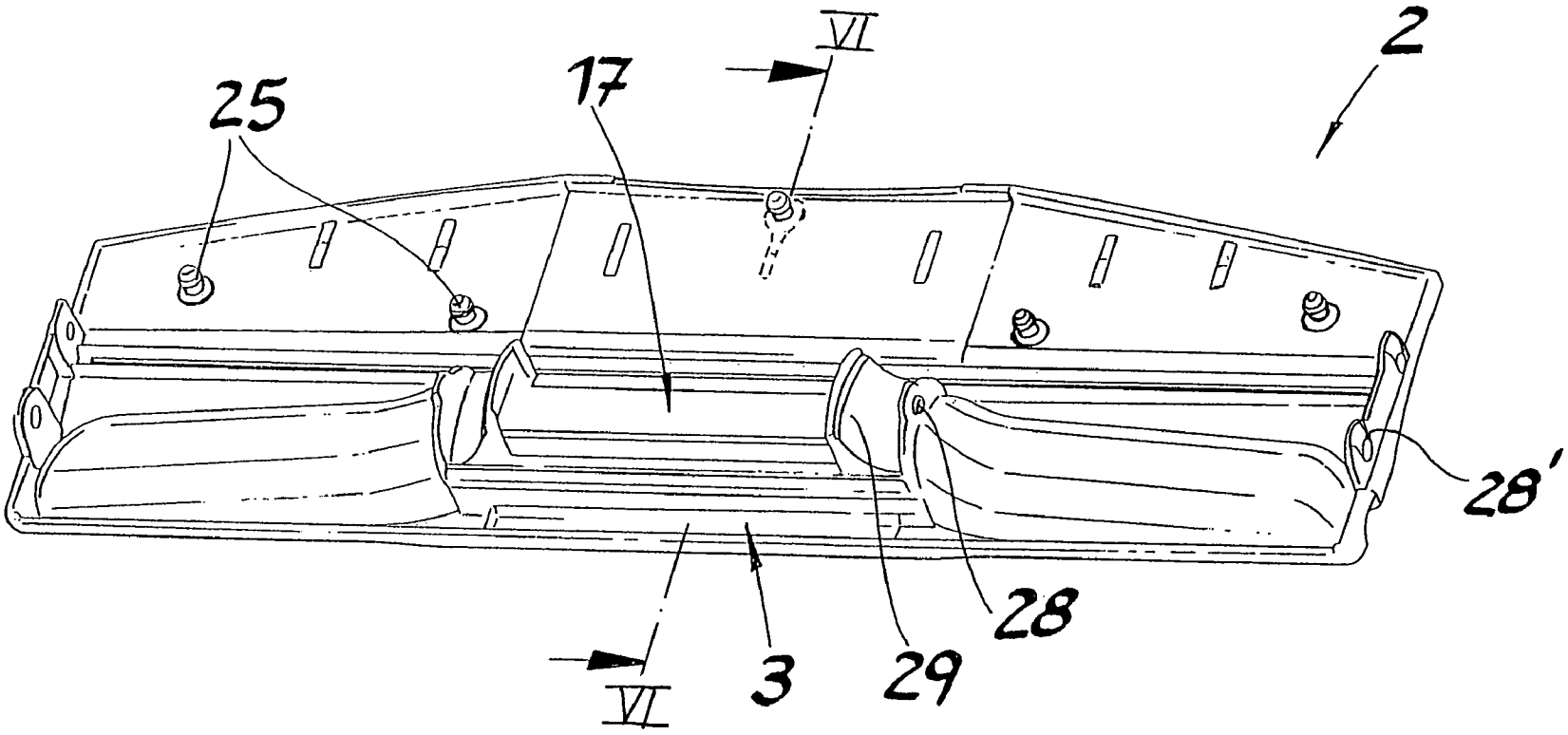
FIG. 5 shows a single component drawing of the slide sole in a representation that is enlarged relative to FIG. 4.

Rocker 4 is guided at two of the pivots formed by slip joints 23 and has formed support surfaces 26 for the return springs 11 with one respective guide recess 27, with the assigned pivot reaching through the recess. FIG. 2 shows that the return springs 11 are arranged on the pivots formed by elements 24, 25 between slide sole 2 and support surfaces 26 of gasket base 4. The pivots formed by slip joints 23 brace the housing of the vacuum cleaner nozzle, which is comprised of slide sole 2 and upper part 1 of the housing, and stabilize slide sole 2. A plurality of the counter elements 25 are arranged on a flat segment of slide sole 2, which connects behind the suction port 3 in a working direction. In addition, catch projections 28, 28' are formed at slide sole 2, which can be affixed at connecting piece 13 of the upper part of the housing and at the wall surfaces of upper part 1 of the housing (FIG. 1). A comparative view, in particular of FIGS. 1, 5 and 6, furthermore reveals that opening 17 of slide sole 2, which runs into suction channel 12, is surrounded by formed projections 29 that engage in connecting piece 13 of suction channel 12 and seal the transition between suction port 3 of slide sole 2 and suction channel 12 of upper part 1 of the housing against extraneous air. In the embodiment, the gasket base has two respective cross-members 22 on both sides of suction channel 12, which are spaced such that impact switch 8 dips into the free space between adjacent cross-members 22. The contact surfaces 10 cooperating with actuating lever 6 are also arranged between cross-members 22.

Figure 4:
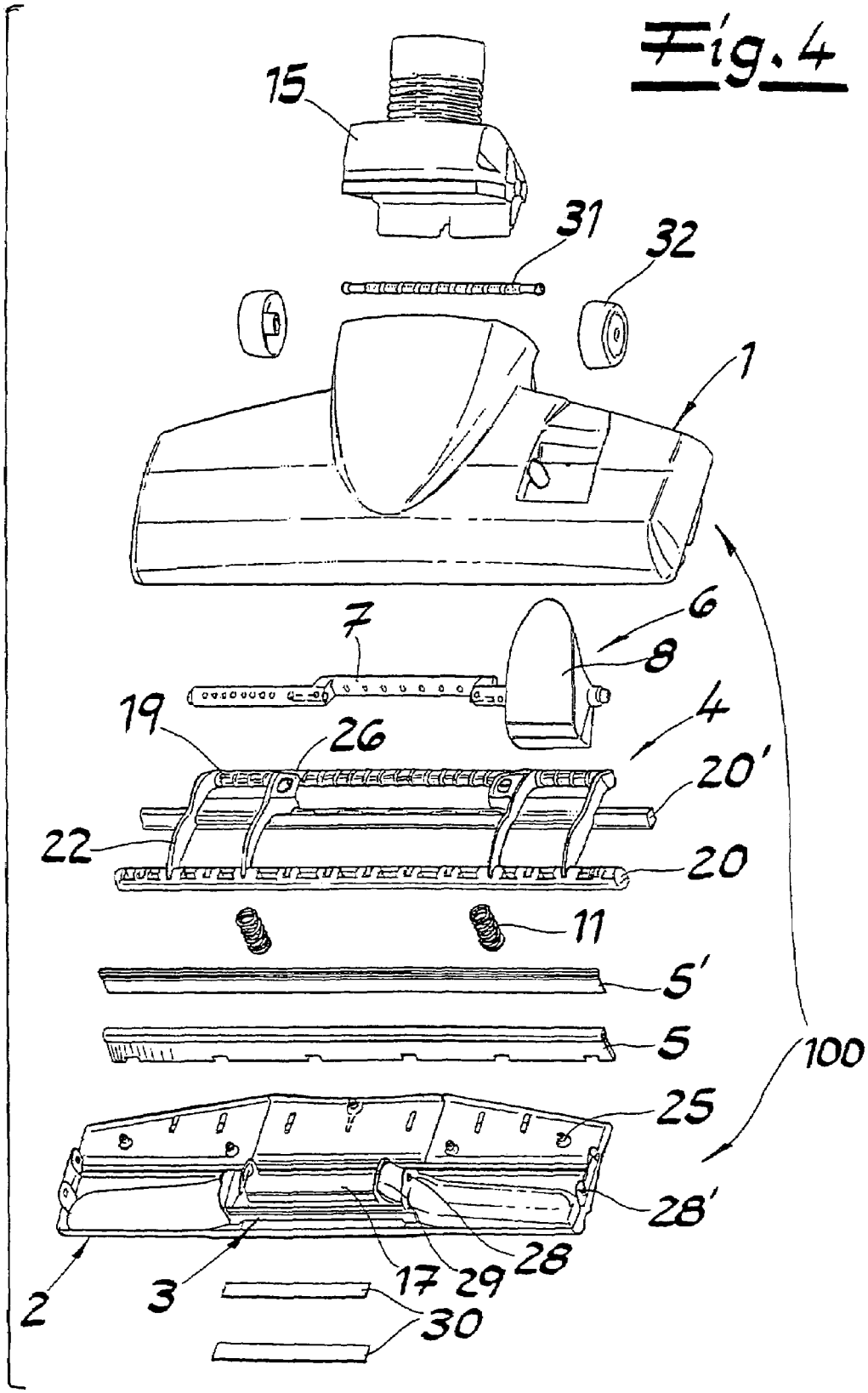
FIG. 4 shows an exploded view of the vacuum cleaner nozzle in accordance with the invention.

In front of and behind suction port 3, slide sole 2 has recesses, with thread lifting strips 30, for example of tilted bristle velour, being glued into said recesses. Furthermore, FIG. 4 shows that hinge joint 15 has an integral shaft axis 31, with wheels 32 being plugged onto the ends of the shaft axis. Upper part 1 of the housing, slide sole 2, rocker 4 as well as actuating lever 6 are one-piece plastic moldings that can be produced economically in the injection molding process and are used without machining. During the assembly, actuating lever 6, rocker 4 as well as return springs 11 are positioned inside the upper part of the housing. Then plastic slide sole 2 is engaged with upper part 1 of the housing. The vacuum cleaner nozzle does not comprise any screws and can be produced economically with the use of fully automated assembly facilities.

Accordingly, while only a few embodiments of the present invention have been shown and described, it is obvious that many changes and modifications may be made thereunto without departing from the spirit and scope of the invention.

What is claimed is:

1. A vacuum cleaner nozzle for floors and carpets, comprising:

a housing comprised of an upper part and a slide sole;

a pivotable rocker located inside the housing on a rear segment in a working direction;

an actuating lever to operate the rocker; and strip-shaped gasket elements arranged in a working direction in front of and behind a suction port formed in the slide sole, said gasket elements being adapted to be retracted and moved out of openings at a lower side of the housing with a swivel motion of the rocker, wherein the rocker is comprised of a pin-jointed frame plastic molding having a rod with cylindrical bearing surfaces and parallel profile strips to fasten the gasket elements as well as cross-members that connect the rod and the profile strips, and wherein the cross-members are arranged on both sides of a suction channel that runs inside of the housing to an opening in the suction port.

2. The vacuum cleaner nozzle according to claim 1, wherein the rocker is guided on pivots that extend from the slide sole to the upper part of the housing and brace the housing.

3. The vacuum cleaner nozzle according to claim 2, wherein the rocker is supported on return springs that are arranged on the pivots.

4. The vacuum cleaner nozzle according to claim 1, wherein the rocker has two crossmembers on each side of the suction channel, with the actuating lever dipping into a free space between adjacent cross-members and wherein there are contact surfaces of the rocker arranged between the crossmembers that also cooperate with the actuating lever.

5. The vacuum cleaner nozzle according to claim 1, wherein the actuating lever is comprised of a pivotable shaft, at least one actuating surface developed as an impact switch, and formed cam lobes, said cam lobes acting on an assigned contact surface of the rocker.

* * * * *